United States Patent [19]

Noffsinger

[11] Patent Number: 4,647,039

[45] Date of Patent: Mar. 3, 1987

[54] IMPINGEMENT EXERCISER WITH FORCE MONITORING AND FEEDBACK SYSTEM

[75] Inventor: Kent E. Noffsinger, Butte, Mont.

[73] Assignees: Lee E. Keith; Stephen D. Morris, both of Buffalo, N.Y. ; part interest to each

[21] Appl. No.: 670,344

[22] Filed: Nov. 8, 1984

[51] Int. Cl.[4] ..... A63B 21/00

[52] U.S. Cl. ..... 272/125; 272/136; 272/DIG. 6

[58] Field of Search ..... 272/125, 134, 136, 116, 272/129, DIG. 6

[56] References Cited

U.S. PATENT DOCUMENTS

| | | | |
|---|---|---|---|
| 3,372,928 | 3/1968 | Showalter | 272/125 |
| 3,848,467 | 11/1974 | Flavell . | |
| 3,998,100 | 12/1976 | Pizatella et al. . | |
| 4,138,106 | 2/1979 | Bradley . | |
| 4,235,437 | 11/1980 | Ruis et al. . | |
| 4,354,676 | 10/1982 | Ariel | 272/134 |
| 4,355,633 | 10/1982 | Heilbrun | 272/125 |

FOREIGN PATENT DOCUMENTS 95832 12/1983 European Pat. Off. .

*Primary Examiner*—Leo P. Picard

*Attorney, Agent, or Firm*—Harvey B. Jacobson

[57] ABSTRACT

An impingement member is moved in a predetermined path and direction at a velocity and with a force independent of each other with the user applying a resistance force to the impingement member at any point along or throughout its range of movement. In the disclosed embodiment, a bar is coupled to a pair of mechanical drive assemblies powered by DC motor through a disengageable clutch. Omnidirectional forces transmitted are monitored through sensors associated with the bar during movement thereof along a path by the drive assemblies. A sensor monitors the position, speed at position, direction, and reference information of the drive assemblies. The force and motion data from the sensors may be utilized to evaluate muscle response and provide biofeedback from different loading patterns and to control loading programs.

4 Claims, 7 Drawing Figures

10
12
44
24
4
46
56
52
20
59
54
4
58
42
18
38
22
14
88
32
84
30
26

IMPINGEMENT EXERCISER WITH FORCE MONITORING AND FEEDBACK SYSTEM

BACKGROUND OF THE INVENTION

This invention relates to an impingement exerciser, exercise monitor training apparatus, rehabilitation apparatus, feedback training and monitoring equipment for control and biofeedback.

Apparatus and associated control systems providing force/resistance or muscular contraction loading for an exerciser are already well known as disclosed, for example, in U.S. Pat. Nos. 3,848,467, 3,998,100 and 4,138,106. Such prior apparatus often features a horizontal bar through which muscular contraction loading is applied to the exerciser by controlled force transmission and motion of the bar in accordance with a predetermined muscular contraction mode for body conditioning purposes. Generally, such prior apparatus are limited to a single contraction mode because of physical arrangement and control interfacing. Such prior physical arrangements are also costly to manufacture and maintain in acceptable working condition.

It is therefore an object of the present invention to provide an improved impingement exerciser with force monitoring and feedback system for multi-modal muscular contraction/extension loading.

One form of the invention has been disclosed but it is pointed out that the concepts may be embodied in various structural arrangements and may be used for various purposes as set forth in more detail hereinafter.

SUMMARY OF THE INVENTION

In accordance with the disclosed form of the present invention which conforms with a fully operational prototype, a horizontal bar is bidirectionally loaded at opposite end portions thereof by separate drive assemblies of the mechanical linkage type through non-rotative end couplings which include elastically deformable shaft sections within which all forces are transmitted and monitored by strain gauge types of forces sensors providing symmetrical as well asymmetrical analog force measurements. The position, velocity, acceleration and other physical relationships of such monitored force measurements with respect to motion are provided by the digital output of an optical type of position sensor located at one or both of the opposite ends of a drive axle to which the mechanical drive assemblies are connected. The drive axle is powered by an energy source in the form of a DC motor coupled thereto through a disengageable clutch.

The DC motor and clutch are controlled either manually or by operational control signals obtained from a computer to which the analog and digital monitoring signals, aforementioned, are fed. Such input data is stored, readout on demand and influences the operational control signals generated by the computer in accordance with a selected loading pattern or program. The interfacing between the apparatus and the computer also provides for the collection of data useful in the study of human muscle response to a variety of loading patterns.

These together with other objects and advantages which will become subsequently apparent reside in the details of construction and operation as more fully hereinafter described and claimed, reference being had to the accompanying drawings forming a part hereof which illustrate only one manifestation of the concepts of this invention, wherein like numerals refer to like parts throughout.

DETAILED DESCRIPTION OF THE DISCLOSED EMBODIMENT

Figure 1:
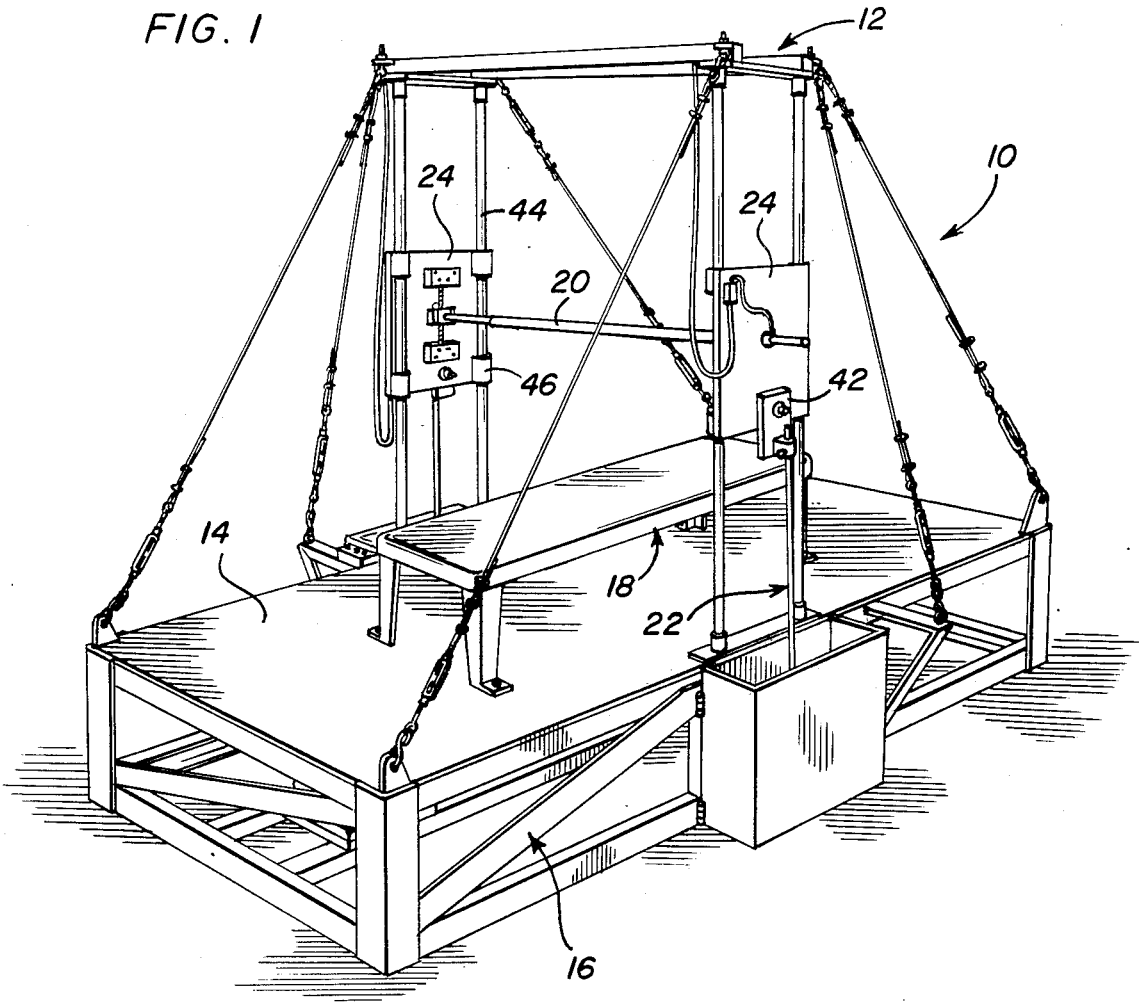
FIG. 1 is a perspective view showing apparatus constructed in accordance with one embodiment of the present invention.
Figure 2:
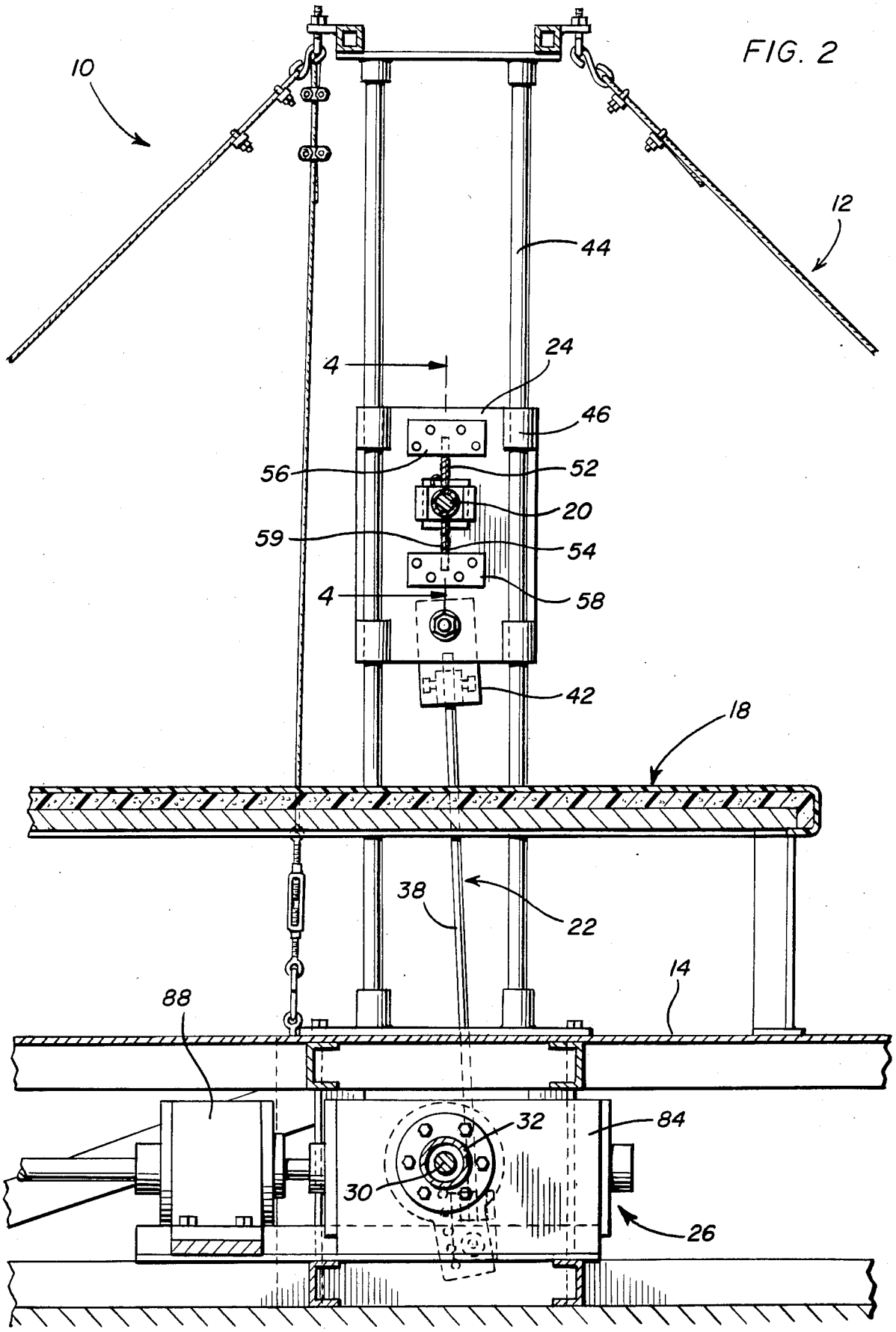
FIG. 2 is an enlarged, partial longitudinal sectional view through the apparatus shown in FIG. 1.
Figure 3:
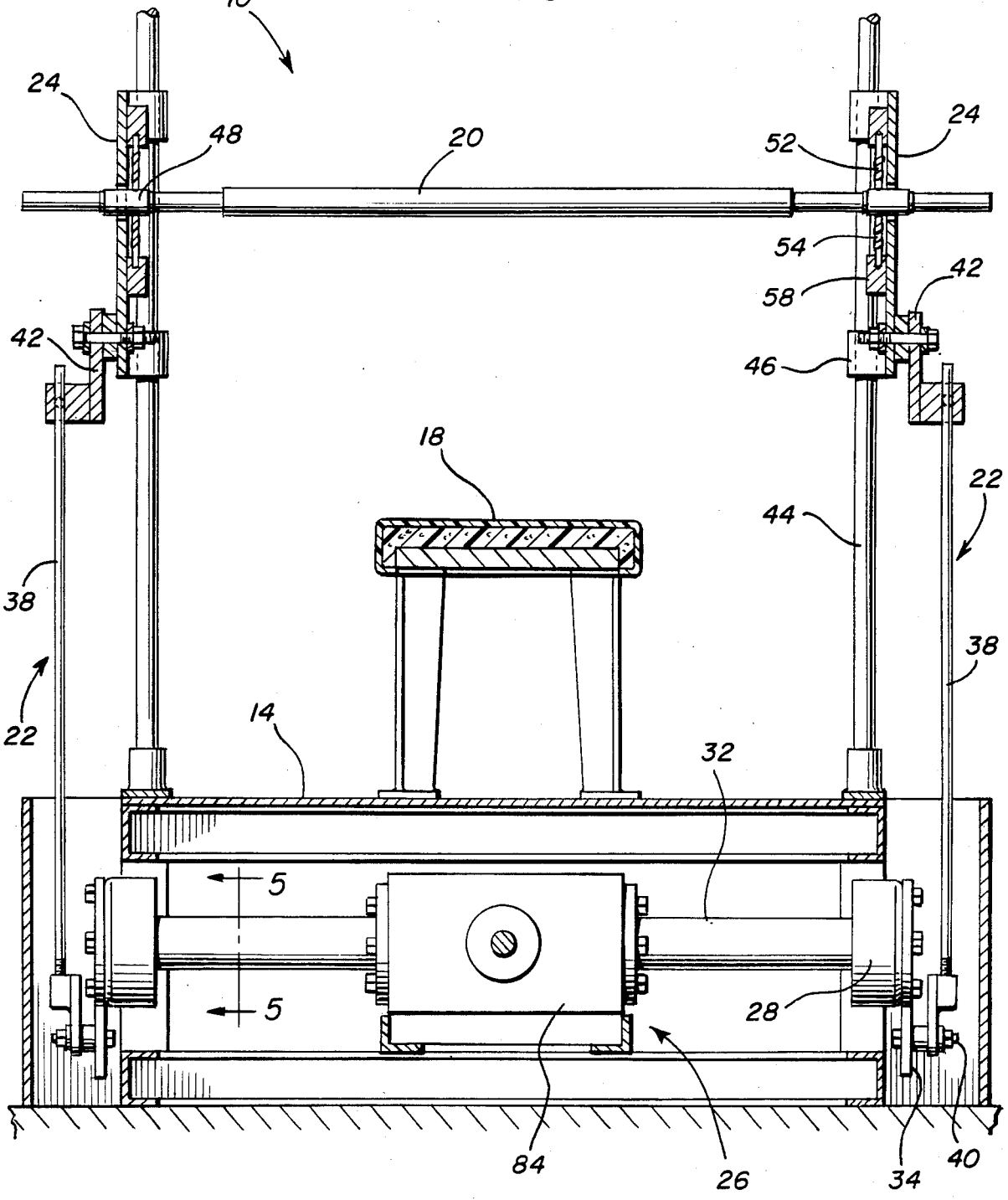
FIG. 3 is an enlarged side sectional view through the apparatus shown in FIG. 1.

Referring now to the drawings in detail, FIGS. 1, 2 and 3 illustrate apparatus constructed in accordance with one embodiment of the invention, generally referred to by reference numeral 10. The apparatus includes any suitable frame assembly 12 mounted on top of a platform 14 elevated somewhat above the floor by supporting side structure 16 to form an enclosure below the platform. An elongated bench 18 is disposed on the platform and fastened thereto below a horizontal bar 20 movably supported by the frame 12 in parallel spaced relation above the platform. The bar 20 constitutes a force applying element adapted to be gripped or engaged by a user of apparatus 10, lying or seated on bench 18.

Opposite end portions of the bar 20 are connected to upper ends of linkage drive assemblies 22 through slide blocks or plates 24 slidably mounted by the frame. The lower ends of the linkage drive assemblies 22 are connected to a power drive system 26 enclosed below the platform 14. As more clearly seen in FIGS. 2, 3 and 6, each linkage drive assembly 22 includes a drum 28 at its lower end connected to a power axle 30 mounted for rotation about a fixed horizontal axis within a fixed bearing tube 32. A crank arm 34 is connected to an outer axial end of drum 28 and has a plurality of holes through one of which a connecting rod 38 is pivotally connected by a crank pin 40. The end of connecting rod 38 opposite crank pin 40 is pivotally connected by pivot element 42 to the slide block 24. Accordingly, rotation of the power axle 30 imparts reciprocatory translation to the bar 20 through the drive linkage assemblies 22.

Figure 4:
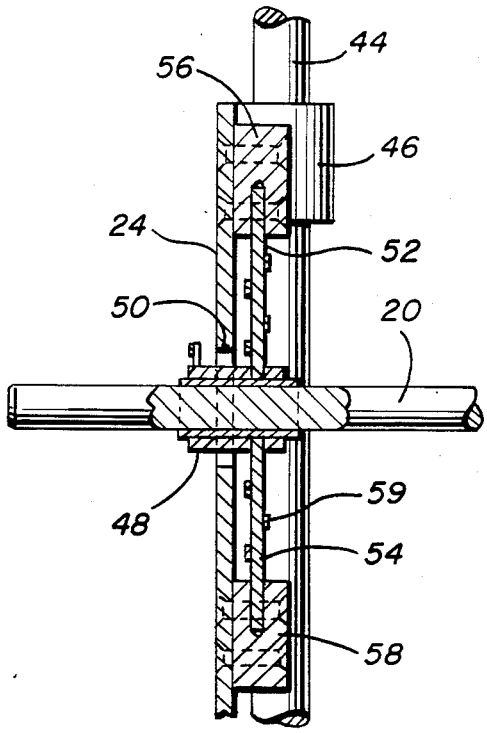
FIG. 4 is an enlarged partial sectional view taken substantially through a plane indicated by section line 4—4 in FIG. 2.

As more clearly seen in FIGS. 2 and 4, each slide block 24 is guided for movement along a vertical path fixed to the frame by means of a pair of vertical guide rods 44 extending through sleeves 46 attached to the slide block at its four corners. A cross-sectionally rectangular sleeve 48 is fixed as by welding to each end portion of the bar 20 and is received with vertical clearance within a rectangular slot 50 formed in the slide plate so as to form part of a non-rotatable coupling to the bar 20. The coupling also includes a pair of elastically deformable shaft sections 52 and 54 fixedly attached to vertically opposite sides of sleeve 48 and to anchor plates 56 and 58 attached by spot welding to the slide plate 24. Thus, bidirectional displacing forces are transmitted between the bar 20 and each slide plate 24 through the shaft sections 52 and 54, which undergo elastic strain. A pair of strain gauges 59 of a well known type producing electrical analog signals are mounted on each shaft section 52 and 54 in order to measure and thereby monitor the forces transmitted.

Figure 5:
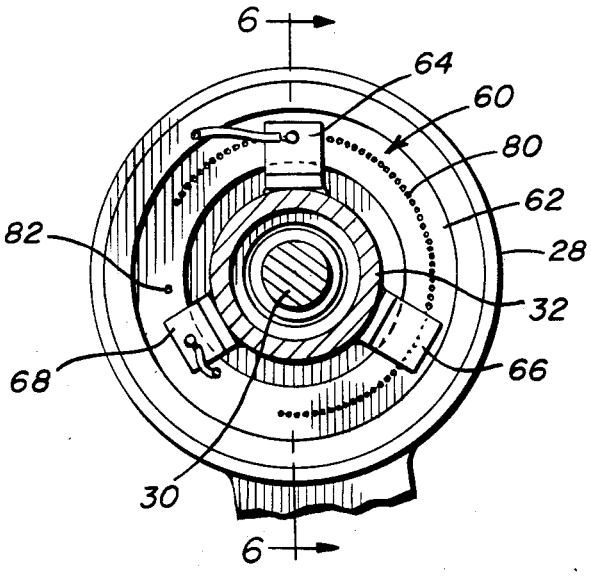
FIG. 5 is an enlarged partial sectional view taken substantially through a plane indicated by section line 5—5 in FIG. 3.
Figure 6:
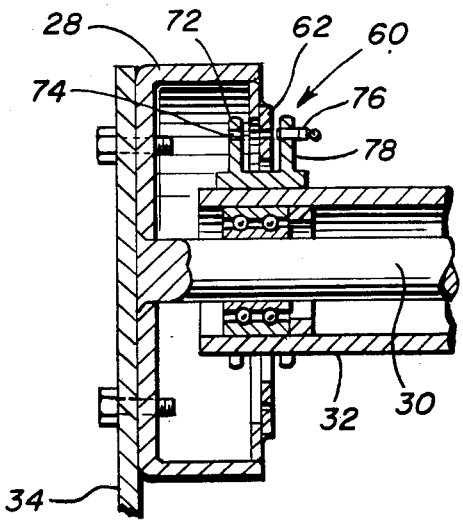
FIG. 6 is a partial sectional view taken through a plane indicated by section line 6—6 in FIG. 5.

Since the displacing force transmitted between the horizontal bar 20 and the linkage drive assemblies 22 is a function of the motion of the linkage assemblies, movement of one or both of the drums 28 is monitored by an optical position sensing encoder assembly generally referred by reference numeral 60 as more clearly seen in FIGS. 5 and 6. The position encoder 60 includes an annular ring 62 fixed to the inside of the drum 28 for rotation therewith, straddled by three flange assemblies 64, 66 and 68 fixedly mounted on tube 32 in angularly spaced relation to each other. Each of the flange assemblies has one flange 72 mounting an infrared light emitting diode (LED) 74 in alignment with a photo-sensitive diode 76 on the other flange 78. The light transmitted from LED 74 to diode 76 is, however, blocked by the annular ring 62 except when aligned with holes formed in the ring. The ring 62 is accordingly provided with two series of closely spaced holes 80 positioned along a circle coaxial with the axle 30 and intersected by the light beam from the LEDs 74 on flange assemblies 64 and 66. The diameter of the holes 80 are preferably equal to the spacing therebetween so as to produce a square wave type digital signal output from the diodes 76 on flange assemblies 64 and 66 in response to rotation of the drum 28. The light beam emitted from the LED 74 on flange assembly 68 intersects another circle, having a diameter different from the circle diameter of the holes 80, on which a single hole 82 lies. Thus, a counter reset signal is produced by flange assembly 68 for each rotation of the drum for processing the digital data obtained from the signal outputs of the diodes 76 on flange assemblies 64 and 66.

Figure 7:
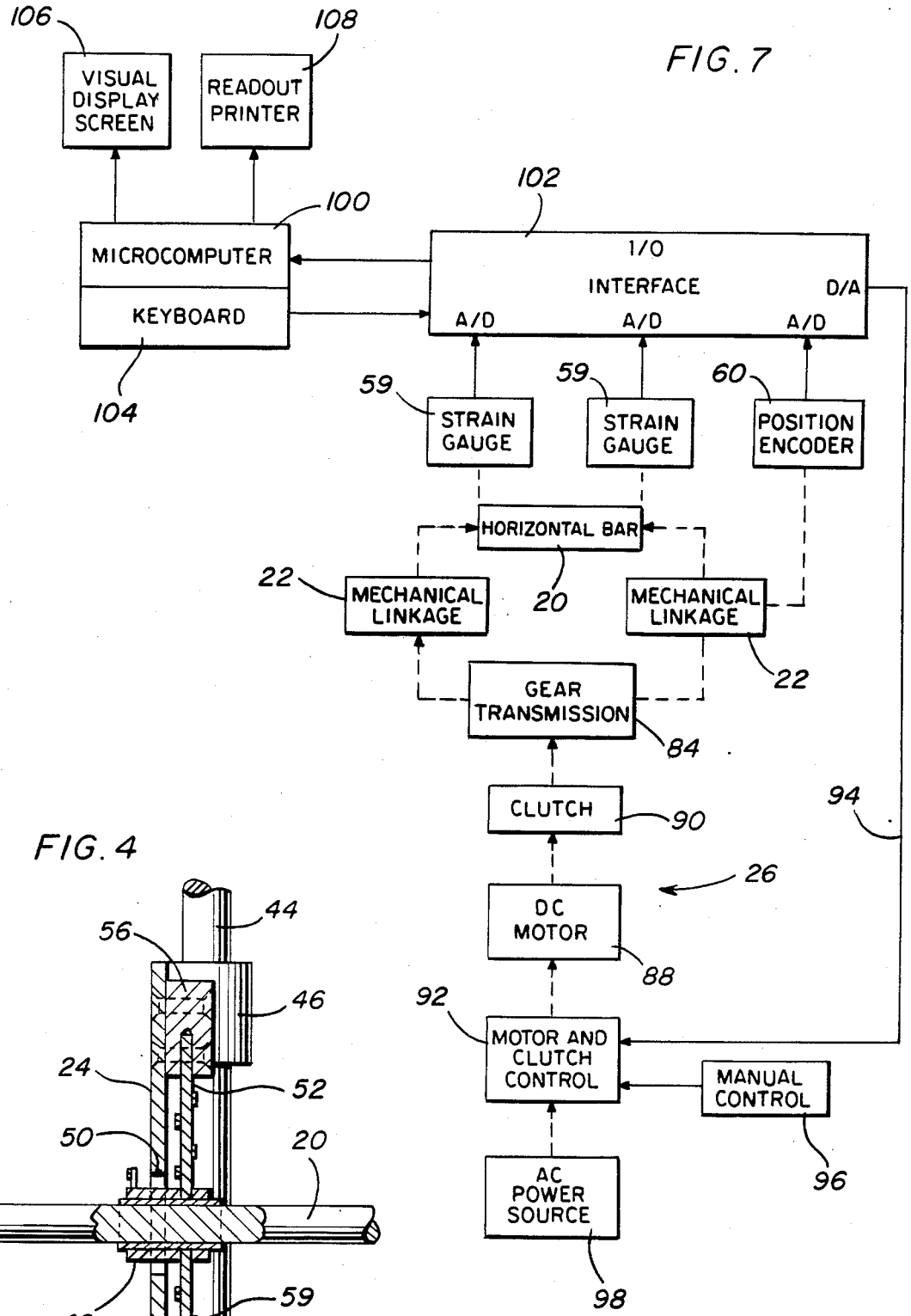
FIG. 7 is a block circuit diagram schematically illustrating the control system associated with the apparatus of the present invention.

Powered rotation is imparted simultaneously to both drums 28 at the ends of the power axle 30 aforementioned by means of the power drive system 26 which is diagrammed in FIG. 7. The axle 30 is driven through transaxle gearing and 4:1 reduction gear 84 by a 5 hp. DC motor 88. The output shaft of motor 88 is releasably coupled to the gearing 84 by an electromagnetically controlled clutch 90.

As schematically shown in FIG. 7, the DC motor 88 and clutch 90 are controlled by a motor control component 92 of a regenerative type so as to enable the motor to follow either input signals received through signal line 94 or from a manual control 96. An AC power source 98, such as a commercial 230 volt, single phase, 60 megaherz power supply, is connected to the DC motor and clutch through the control 92. Analog input signals in line 94 are derived from a microcomputer 100 through an interface 102 to which analog inputs are fed from the strain gauges 59 aforementioned measuring the forces being transmitted between the horizontal bar 20 and the mechanical linkage assemblies 22. The digital input from the position encoder 60 is also fed to the interface to provide motion phase data. A keyboard 104 associated with the computer 100 is utilized to select and initiate operation of apparatus 10 in accordance with a selected program or algorithm based on the data derived from the force measuring and monitoring inputs of the strain gauges 59 and position encoder 60. The data obtained by the monitoring measurements of the strain gauges 58 and position encoder 60 may also be readout under direction of the keyboard 104 on a display screen 106 and a printer 108 including asymmetrical force readings to determine the relative strength of left and right arms or legs and velocity or other motion data. The computer 100 may be programmed to produce any desired loading mode by the bar 20 including conventional dynamic concentric, dynamic eccentric, isokinetic, isometric and modified variations thereof. Further, programming may be included to selectively provide a biofeedback capability. Also, through the clutch 90 rapid power disengagement may be effected as a safety measure in response to detection of certain conditions based on measurement data being recorded or readout and emperical experience data stored in the computer memory.

As indicated previously, the prototype, as disclosed, is functional but many variations, alternative structures and improvements may be incorporated therein. The impingement exerciser may be effectively utilized in conjunction with various athletic training procedures, body and muscle conditioning procedures and rehabilitation with monitoring and feedback techniques. However, the exerciser without the computer, gauges and related structures still provides a novel and unique exerciser concept in which force and velocity are totally independent. As examples of the structural variations, the horizontal bar 20, as disclosed need not always be horizontal and the vertical standards may be free to pivot together or independently for twising motion. Likewise, the bar 20 or impingement member is not necessarily non-rotative inasmuch as a sleeve could be mounted on the bar that is either fixed or free for adjustment. Also, the exerciser is not restricted to a horizontal bar but could have cables attached through frame supported pulleys to redirect forces to provide motion at any angle and at any level. Also, a yoke with handles or other setups or equipment could be driven with one drive assembly or cable. The pair of drive assemblies could be independent to get a "seesaw" effect with the bar 20 being fixed to the plates using ball-type joints. The movement of the bar or other impingement member may be omnidirectional with selective capability for all three axes. Various types of devices may be used in lieu of strain gauges with such devices being mechanical, electronic or the like having the desired sensitivity and dynamic range on each independent axis of movement. The force determining arrangements may be connected with the ends of the bar as indicated or along the bar to obtain curvature readings or on the yoke if used on cables. The impingement member or bar does not have to move to obtain readings as isometrics or any pattern can be performed with monitor and control feedback. The motion of the impingement member or bar is not necessarily cyclic or reciprocating but can have any forward/reverse pattern. Thus, the impingement member or bar does not necessarily have to move in a fixed vertical path although this is true of the disclosed prototype since the impingement member or bar can move omnidirectionally as indicated previously. The sensors related to the drive arrangement provide position, speed at position, direction and reference information and includes the possibility of providing two independent systems for two sides of the device to measure asymmetrical performance. The data from the sensors may be utilized directly or after the data has been introduced into the computer, recorded or the like and is utilized in real time or delayed evaluation and for biofeedback training or effect as well as control of loading programs. The loading patterns or programs may involve real time generated as well as preprogrammed pattern and the machine is inherently inertia free but can be programmed to behave with inertia-like characteristics. Also, user generated forces can be monitored or recorded and controlled in the biofeedback mode.

In this concept, controlled forces are provided to the user and are independent user generated quantities. Such user generated forces can be monitored/recorded or controlled in the biofeedback mode. At full utilization, the present invention could be in a mode where the user is defining the forces by setting them at any instant without any adjustment or distraction at real time, utilizing monitored signals for biofeedback control of force performance with the machine programmed in any manner of response for monitored signal control with monitored signals being permanently or temporarily stored for later review either by computer or observation of the user with such information thus being available for the current performance capability of the user and for determining long-term or short-term performance and change of performance to program future routines for endurance/recovery curves and finally for comparison with other data from other sources thereby providing significant new data relating to the user. One example of such data would be comparative asymmetry data. Defining further the concept of this invention, it provides velocity/position profile with or without forces which is user controlled, that is, when the user resists there are forces proportioned to the resistance with the machine movement and positioning, however, being independent of this. This capability provides a subtle but major distinction between the state of the art and what the present invention provides. Thus, action/-reaction forces can be used to control the velocity/position profile of the apparatus so that these profiles become functions of the forces.

The power source is optional since various types of motors and power devices may be utilized and the disengageable clutch which is a power-on safety clutch may be used but other similar clutches or devices may be utilized so that when the clutch disengages, the user will be protected with inertia of the drive system. The bench illustrated in the drawings is not necessarily needed or fastened in place nor does the user require the bench when using the device. Essentially, the release of the force element or impingement element by the user does not change the motion of the machine unless such a change is desired which is totally different from current state of the art devices. The apparatus can oscillate between isometric, isotonic, isokinetic and the like in any manner desired and the drive system may be reversible in any manner such as electronically or the like and the drive system is regenerative. As an alternative, a screwjack system could be used which is quite flexible in use and is compact in design. U-joint couplings may be used to provide universal orientation of the impingement member or other components with the machine providing both static impingement and dynamic impingement with the various details of construction being varied while maintaining the essential concepts of the invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In an exerciser, an impingement member, a source of motive energy, means for transmitting force between the energy source and the impingement member, means for monitoring the physical characteristics of movement of the impingement member and means for guiding movement of the impingement member, said force transmitting means including mechanical drive means operatively connected to the impingement member, said impingement member having opposite end portions, said mechanical drive means including a pair of reciprocating linkage assemblies respectively coupled to said opposite end portions of the impingement member, said guiding means including at least two fixed rods and slide blocks mounted thereon, means non-rotatively coupling the slide blocks to said opposite end portions of the impingement member for translation therewith along a path established by the fixed rods, and elastically stressed means interconnecting the coupling means and the slide blocks for transmitting translatory forces therebetween, said monitoring means including strain gauges mounted on said elastically stressed connecting means to produce analog signals proportional to the translatory forces transmitted.

2. The improvement as defined in claim 1 wherein the mechanical drive means further includes rotatable crank means operatively coupling the linkage assemblies to the energy source, said monitoring means further including position sensing means responsive to rotation of the crank means for producing digital signals as a function of such rotation.

3. The improvement as defined in claim 2 wherein the energy source comprises an electrical motor drivingly connected to the crank means through clutch means, said impingement member being a horizontal bar.

4. The improvement as defined in claim 1 including clutch means operatively connected between the energy source and the linkage assemblies for disabling the exerciser.

* * * * *